US005815998A

United States Patent [19]

Wamsher

[11] Patent Number: 5,815,998

[45] Date of Patent: Oct. 6, 1998

[54] DOOR JAMB PROTECTOR APPARATUS

[76] Inventor: Lawrence G. Wamsher, 6301 SW. 7th, Des Moines, Iowa 50315

[21] Appl. No.: 698,111

[22] Filed: Aug. 15, 1996

[51] Int. Cl.[6] ..... E06B 1/04

[52] U.S. Cl. ..... 52/211; 52/732.1; 52/732.3; 52/736.4; 49/462; 248/345.1

[58] Field of Search ..... 52/211, 732.1, 52/732.3, DIG. 12, 736.4; 49/462; 248/345.1; 108/27; 312/140.4

[56] References Cited

U.S. PATENT DOCUMENTS

| | | | |
|---|---|---|---|
| D. 289,890 | 5/1987 | Adell . | |
| 4,281,480 | 8/1981 | Wendt | 52/211 X |
| 4,437,916 | 3/1984 | Adell | 49/462 X |
| 4,443,508 | 4/1984 | Mehl . | |
| 4,520,593 | 6/1985 | Adell | 49/462 |
| 4,555,870 | 12/1985 | McKinnon et al. . | |
| 4,768,320 | 9/1988 | Weller . | |
| 4,803,810 | 2/1989 | Adell | 49/462 |
| 5,203,130 | 4/1993 | Freelove . | |
| 5,271,662 | 12/1993 | Saul | 248/345.1 X |
| 5,351,733 | 10/1994 | Ullman . | |
| 5,496,609 | 3/1996 | Michelstein | 248/345.1 X |

*Primary Examiner*—Creighton Smith
*Assistant Examiner*—W. Glenn Edwards

[57] ABSTRACT

A door jamb protector apparatus includes a first flexible clamp portion having one edge connected to one edge of a flexible back portion. A second flexible clamp portion includes one edge connected to another edge of the flexible back portion. Each of the first flexible clamp portion, the flexible back portion, and the second flexible clamp portion has a resilient exterior surface and a resilient interior surface. The first flexible clamp portion, the flexible back portion, and the second flexible clamp portion are comprised of a single material in a form of a unified, integrated structure. The resilient exterior surface of the first flexible clamp portion and the resilient exterior surface of the second flexible clamp portion are substantially concave. The resilient exterior surface of the flexible back portion is substantially convex. The unified, integrated structure is substantially U-shaped and is comprised of a resilient plastic foam material, such as polyurethane foam. Each of the first flexible clamp portion, the flexible back portion, and the second flexible clamp portion includes a relatively high density core portion sandwiched between a relatively low density resilient exterior surface and a relatively resilient interior surface. The relatively low density resilient exterior surface and the relatively low density resilient interior surface are comprised of a plastic foam material, and the relatively high density core portion is comprised of a plastic sheet material. The plastic foam material is comprised of polyurethane foam, and the plastic sheet material is comprised of polyethylene sheet.

5 Claims, 2 Drawing Sheets

DOOR JAMB PROTECTOR APPARATUS

BACKGROUND OF THE INVENTION

1. Field of the Invention

The present invention relates generally to protective covers and, more particularly, to a protective cover especially adapted for covering a portion of a door jamb.

2. Description of the Prior Art

When construction workers pass through doorways, the workers often carry equipment and materials which may scratch, chip, crack, or otherwise damage portions of the door jamb. The same problem can occur when movers are moving a person's belongings either into or out of an office or residence. In this respect, it would be desirable if a device were provided that protected portions of a door jamb from damaging contact by articles when the articles are moved through a doorway.

When an article passes through a doorway and bumps into a portion of the door jamb, the article itself may also become damaged in some way. In this respect, it would be desirable if a device were provided that protects articles that pass through a doorway from being damaged by contact with a door jamb.

Throughout the years, a number of innovations have been developed relating to protectors for portions of a door jamb, and the following U.S. Pat. Nos. are representative of some of those innovations: 4,768,320 and 5,203,130. More specifically, U.S. Pat. No. 4,768,320 discloses a door frame guard that has a relatively stiff outer shell and a relatively soft inner lining. The relatively soft inner lining may well protect a door jamb from damage from articles moved through a doorway. However, the relatively stiff outer shell may damage articles that pass through the doorway and contact the door frame guard. In this respect, it would be desirable if a door jamb protector device were provided that has a relatively soft outer surface.

U.S. Pat. No. 5,203,130 discloses a door frame shield that includes four interfitting, relatively adjustable, stiff component parts. For purposes of simplicity of manufacture and use, it would be desirable if a door jamb protector device were provided which does not include a plurality of relatively adjustable, interfitting component parts.

In addition, the following U.S. patents may be of interest for their disclosure of protectors that protect the edges of movable planar sheet articles such as doors: U.S. Pat. Nos. 4,443,508, 4,555,870, 5,351,733, and Pat. Des. No. 289,890.

Still other features would be desirable in a door jamb protector device. For example, door jambs are not all the same thickness. In this respect, it would be desirable if a door jamb protector device were provided that is flexible and can be easily bent to be adapted to door jambs having different thicknesses. Furthermore, for purposes of simplicity and economy, it would be desirable if a door jamb protector were provided which is composed of a single component part.

Thus, while the foregoing body of prior art indicates it to be well known to use door jamb protectors, the prior art described above does not teach or suggest a door jamb protector apparatus which has the following combination of desirable features: (1) protects portions of a door jamb from being damaged by contact by articles when the articles are moved through a doorway; (2) protects articles that pass through a doorway from being damaged by contact with a door jamb; (3) has a relatively soft outer surface; (4) does not include a plurality of relatively adjustable, interfitting component parts; (5) can be easily flexed to be adapted to door jambs having different thicknesses; and (6) is composed of a single component part. The foregoing desired characteristics are provided by the unique door jamb protector apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a door jamb protector apparatus which includes a first flexible clamp portion having one edge connected to one edge of a flexible back portion. A second flexible clamp portion includes one edge connected to another edge of the flexible back portion. Each of the first flexible clamp portion, the flexible back portion, and the second flexible clamp portion has a resilient exterior surface and a resilient interior surface.

The first flexible clamp portion, the flexible back portion, and the second flexible clamp portion are comprised of a single material in a form of a unified, integrated structure. The resilient exterior surface of the first flexible clamp portion and the resilient exterior surface of the second flexible clamp portion are substantially concave. The resilient exterior surface of the flexible back portion is substantially convex. The unified, integrated structure is substantially U-shaped and is comprised of a resilient plastic foam material, such as polyurethane foam.

Each of the first flexible clamp portion, the flexible back portion, and the second flexible clamp portion includes a relatively high density core portion sandwiched between a relatively low density resilient exterior surface and a relatively resilient interior surface. The relatively low density resilient exterior surface and the relatively low density resilient interior surface are comprised of a plastic foam material, and the relatively high density core portion is comprised of a plastic sheet material. The plastic foam material is comprised of polyurethane foam, and the plastic sheet material is comprised of polyethylene sheet.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door jamb protector apparatus which has all of the advantages of the prior art and none of the disadvantages.

It is another object of the present invention to provide a new and improved door jamb protector apparatus which may be easily and efficiently manufactured and marketed.

It is a further object of the present invention to provide a new and improved door jamb protector apparatus which is of durable and reliable construction.

An even further object of the present invention is to provide a new and improved door jamb protector apparatus which is susceptible of a low cost of manufacture with regard to both materials and labor, and which accordingly is then susceptible of low prices of sale to the consuming public, thereby making such door jamb protector apparatus available to the buying public.

Still yet a further object of the present invention is to provide a new and improved door jamb protector apparatus which protects portions of a door jamb from being damaged by contact by articles when the articles are moved through a doorway.

Still another object of the present invention is to provide a new and improved door jamb protector apparatus that protects articles that pass through a doorway from being damaged by contact with a door jamb.

Yet another object of the present invention is to provide a new and improved door jamb protector apparatus which has a relatively soft outer surface.

Even another object of the present invention is to provide a new and improved door jamb protector apparatus that does not include a plurality of relatively adjustable, interfitting component parts.

Still a further object of the present invention is to provide a new and improved door jamb protector apparatus which can be easily flexed to be adapted to door jambs having different thicknesses.

Yet another object of the present invention is to provide a new and improved door jamb protector apparatus that is composed of a single component part.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved door jamb protector apparatus embodying the principles and concepts of the present invention will be described.

Figure 1:
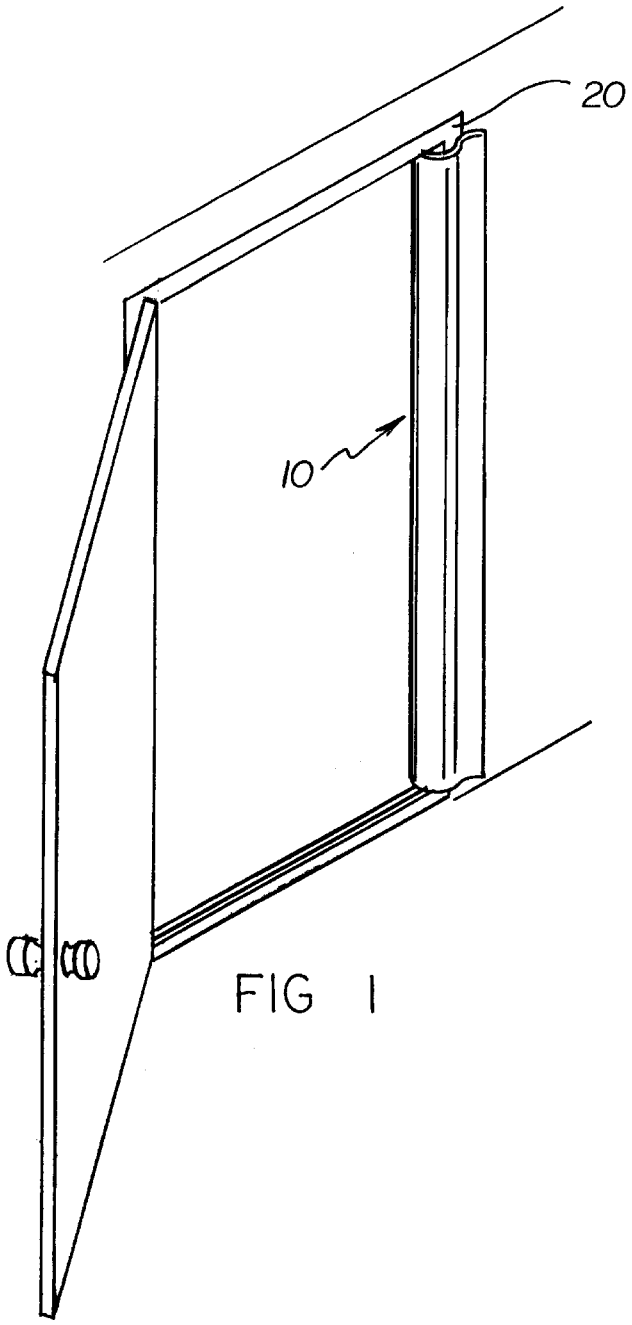
FIG. 1 is a perspective view showing a first embodiment of the door jamb protector apparatus of the invention installed on a door jamb.
Figure 2:
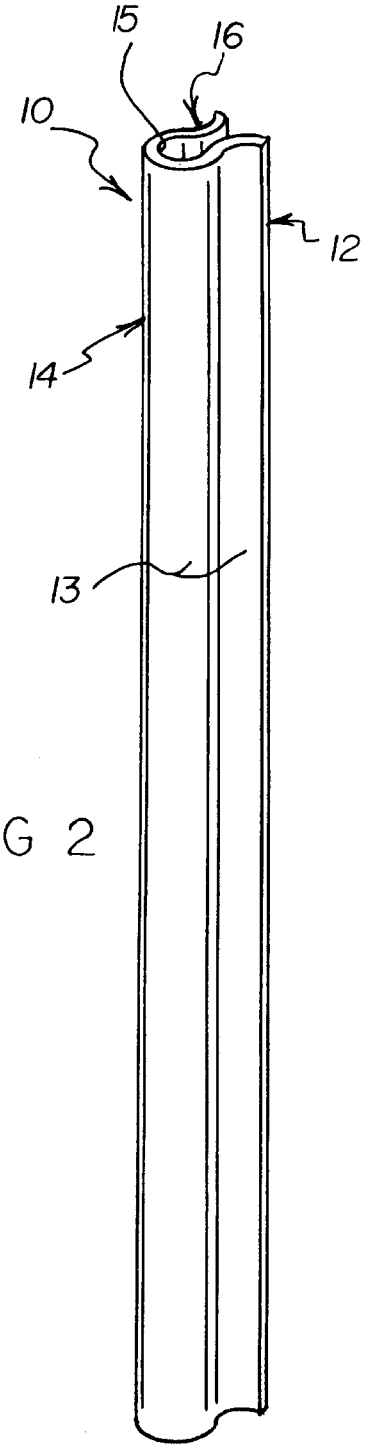
FIG. 2 is an enlarged perspective view of the embodiment of the door jamb protector apparatus shown in FIG. 1 removed from the door jamb.

Turning to FIGS. 1–2, there is shown a first embodiment of the door jamb protector apparatus of the invention generally designated by reference numeral 10. The first embodiment of the door jamb protector apparatus 10 includes a first flexible clamp portion 12 and a flexible back portion 14 having one edge connected to one edge of the first flexible clamp portion 12. One edge of a second flexible clamp portion 16 is connected to another edge of the flexible back portion 14. Each of the first flexible clamp portion 12, the flexible back portion 14, and the second flexible clamp portion 16 has a resilient exterior surface 13 and a resilient interior surface 15.

Figure 4:
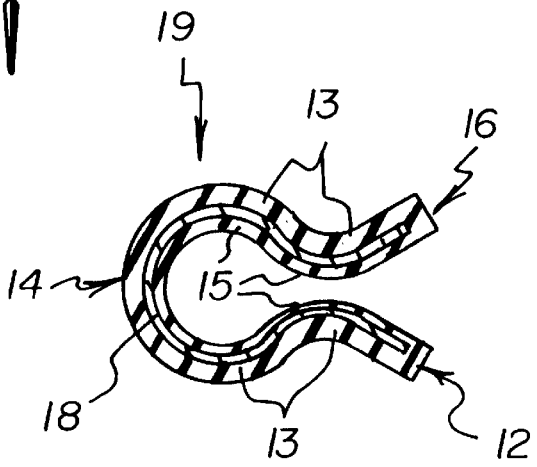
FIG. 4 is a cross-sectional view of the embodiment of the invention shown in FIG. 3 taken along line 4—4 thereof.

In accordance with the first embodiment of the invention shown in FIGS. 1 and 2, the first flexible clamp portion 12, the flexible back portion 14, and the second flexible clamp portion 16 are comprised of a single material in a form of a unified, integrated structure. The resilient exterior surface 13 of the first flexible clamp portion 12 and the resilient exterior surface 13 of the second flexible clamp portion 16 are substantially concave. The resilient exterior surface 13 of the flexible back portion 14 is substantially convex. As shown in FIGS. 2 and 4, the resilient interior surface 15 is substantially concave. The unified, integrated structure is substantially U-shaped and is comprised of a resilient plastic foam material, such as polyurethane foam.

Figure 3:
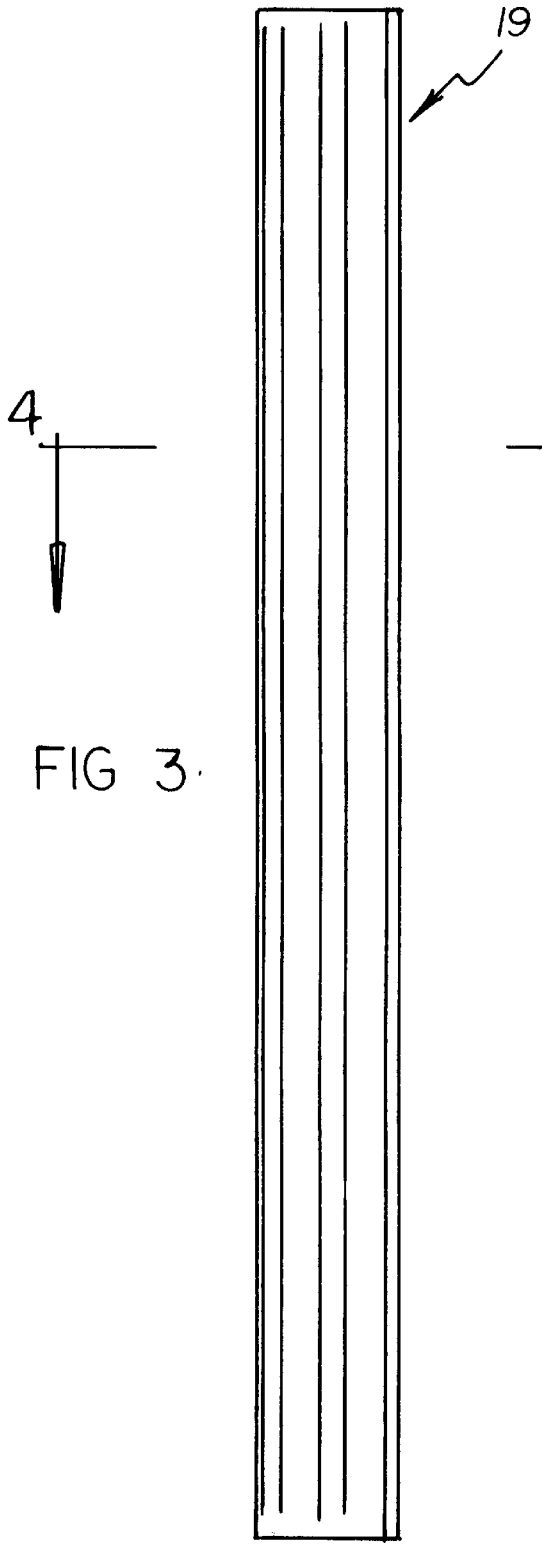
FIG. 3 is a front view of a second embodiment of the door jamb protector apparatus.

Turning to FIGS. 3–4, a second embodiment 19 of the invention is shown. Reference numerals are shown that correspond to like reference numerals that designate like elements shown in the other figures. In addition, each of the first flexible clamp portion 12, the flexible back portion 14, and the second flexible clamp portion 16 includes a relatively high density core portion 18 sandwiched between a relatively low density resilient exterior surface 13 and a relatively resilient interior surface 15. The relatively low density resilient exterior surface 13 and the relatively low density resilient interior surface 15 are comprised of a plastic foam material, and the relatively high density core portion 18 is comprised of a plastic sheet material. The plastic foam material may be comprised of polyurethane foam, and the plastic sheet material may be comprised of polyethylene sheet.

Both embodiments of the invention are capable of being applied to door jambs 20 has a wide range of thicknesses such as, for example, thicknesses ranging from 3 to 8 inches. To apply the door jamb protector apparatus 10 of the invention to a door frame assembly having a door jamb, the first flexible clamp portion 12 and the second flexible clamp portion 16 are grasped, spread apart, and moved over outside sides of the door jamb 20 such as shown in FIG. 1. Then, the first flexible clamp portion 12 and the second flexible clamp portion 16 are released, whereby the first flexible clamp portion 12 and the second flexible clamp portion 16 clamp onto the door jamb 20. In addition, the door jamb protector apparatus 10 of the invention can be made in a variety of lengths to accommodate door jambs having a variety of lengths.

As shown in FIG. 1, the door jamb 20 preferably has a flat planar interior surface (not labeled) intersecting an interior surface (not labeled) of the door jamb at an intersecting edge (not labeled). Because the resilient interior surface 15 of the flexible back portion 14 is substantially concave, the resilient interior surface 15 will be spaced from a majority of the flat planar interior surface of the door jamb when the intersecting edge of the door jamb 20 is abuttingly positioned against the interior surface 15 of the flexible back portion 14.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved door jamb protector apparatus that is low in cost, relatively simple in design and operation, and which may advantageously be used to protect portions of a door jamb from being damaged by contact by articles when the articles are moved through a doorway. With the invention, a door jamb protector apparatus is provided which protects articles that pass through a doorway from being damaged by contact with a door jamb. With the invention, a door jamb protector apparatus is provided which has a relatively soft outer surface. With the invention, a door jamb protector apparatus is provided which does not include a plurality of relatively adjustable, interfitting component parts. With the invention, a door jamb protector apparatus is provided which can be easily flexed to be adapted to door jambs having different thicknesses. With the invention, a door jamb protector apparatus is provided which is composed of a single component part.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A door jamb protector apparatus comprising:

a doorframe assembly including a door jamb extending around the doorframe assembly, the door jamb having a flat planar interior surface intersecting an interior surface of the door lamb at an intersecting edge;

a first flexible clamp portion;

a second flexible clamp portion extending in a spaced and parallel orientation relative to the first flexible clamp portion;

a flexible back portion having first and second edges, the first edge extending in a spaced and parallel orientation relative to the first edge, with the first edge being connected to the first flexible clamp portion and the second edge being connected to the second flexible clamp portion, wherein the clamp portions are positioned on opposed sides of the door jamb of the door assembly such that the first flexible clamp portion, the flexible back portion, and the second flexible clamp portion operate together to encase the door jamb;

wherein each of the first flexible clamp portion, the flexible back portion, and the second flexible clamp portion has a resilient interior surface, whereby the door jamb protector apparatus operates to protect the jamb from abrasive contact with objects being moved through the door assembly;

wherein each of the first flexible clamp portion, the flexible back portion, and the second flexible clamp portion has a resilient exterior surface, whereby the door jamb protector apparatus operates to protect objects being moved through the door assembly from abrasive contact with the door jamb;

wherein the resilient interior surface of the flexible back portion is substantially concave, the resilient interior surface being spaced from a majority of the flat planar interior surface of the door iamb when the intersecting edge of the door lamb is abuttingly positioned against the interior surface of the flexible back portion.

2. The apparatus of claim 1, wherein the resilient exterior surface of the first flexible clamp portion and the resilient exterior surface of the second flexible clamp portion are substantially concave.

3. The apparatus of claim 1, wherein the resilient exterior surface of the flexible back portion is substantially convex.

4. The apparatus of claim 1, wherein the first flexible clamp portion, the flexible back portion, and the second flexible clamp portion are comprised of a single material in a form of a unified and integrated structure.

5. The apparatus of claim 1, wherein each of the first flexible clamp portion, the flexible back portion, and the second flexible clamp portion includes a relatively high density core portion sandwiched between a relatively low density resilient exterior surface and a relatively resilient interior surface.

* * * * *